US005289697A

United States Patent [19]

Hutchison

[11] Patent Number: 5,289,697

[45] Date of Patent: Mar. 1, 1994

[54] REFRIGERANT RECEIVER/DRIER

[75] Inventor: Wayne K. Hutchison, Ingersoll, Canada

[73] Assignee: Eaton Corporation, Cleveland, Ohio

[21] Appl. No.: 967,587

[22] Filed: Oct. 28, 1992

[51] Int. Cl.[5] ..... F25B 43/00

[52] U.S. Cl. ..... 62/474; 62/85

[58] Field of Search ..... 62/474, 475, 292, 85

[56] References Cited

U.S. PATENT DOCUMENTS

| | | | |
|---|---|---|---|
| 1,726,805 | 9/1929 | Carrey | 62/474 |
| 1,809,834 | 6/1931 | Davenport | 62/474 |
| 1,839,350 | 1/1932 | Slagel | 62/474 |
| 2,225,990 | 12/1940 | Henry | 62/474 |
| 2,504,184 | 4/1950 | Dawson | 62/474 |
| 2,705,405 | 4/1955 | Uhlman | 62/474 |
| 3,146,602 | 9/1964 | Swearingen | 62/85 |
| 3,545,227 | 12/1970 | Grahl | 62/474 |
| 4,331,001 | 5/1982 | Jones | 62/503 |
| 4,745,772 | 5/1988 | Ferris | 62/292 |
| 5,038,582 | 8/1991 | Takamatsu | 62/474 |

FOREIGN PATENT DOCUMENTS

| | | | |
|---|---|---|---|
| 1139518 | 11/1962 | Fed. Rep. of Germany | 62/474 |

*Primary Examiner*—Henry A. Bennet
*Assistant Examiner*—William C. Doerrler
*Attorney, Agent, or Firm*—R. A. Johnston

[57] ABSTRACT

A refrigerant receiver/drier having an inner cup-shaped shell received over a standpipe and filled with desiccant beads which are retained by a closure plate fitted over the standpipe. Louvered flow openings are formed in the bottom of the cup and the closure plate with a layer of filter material disposed adjacent the openings. The subassembly thus formed is then secured to a header or base; and, an outer shell received thereover and secured to the header by weldment. The standpipe is press-fitted into the header outlet.

16 Claims, 1 Drawing Sheet

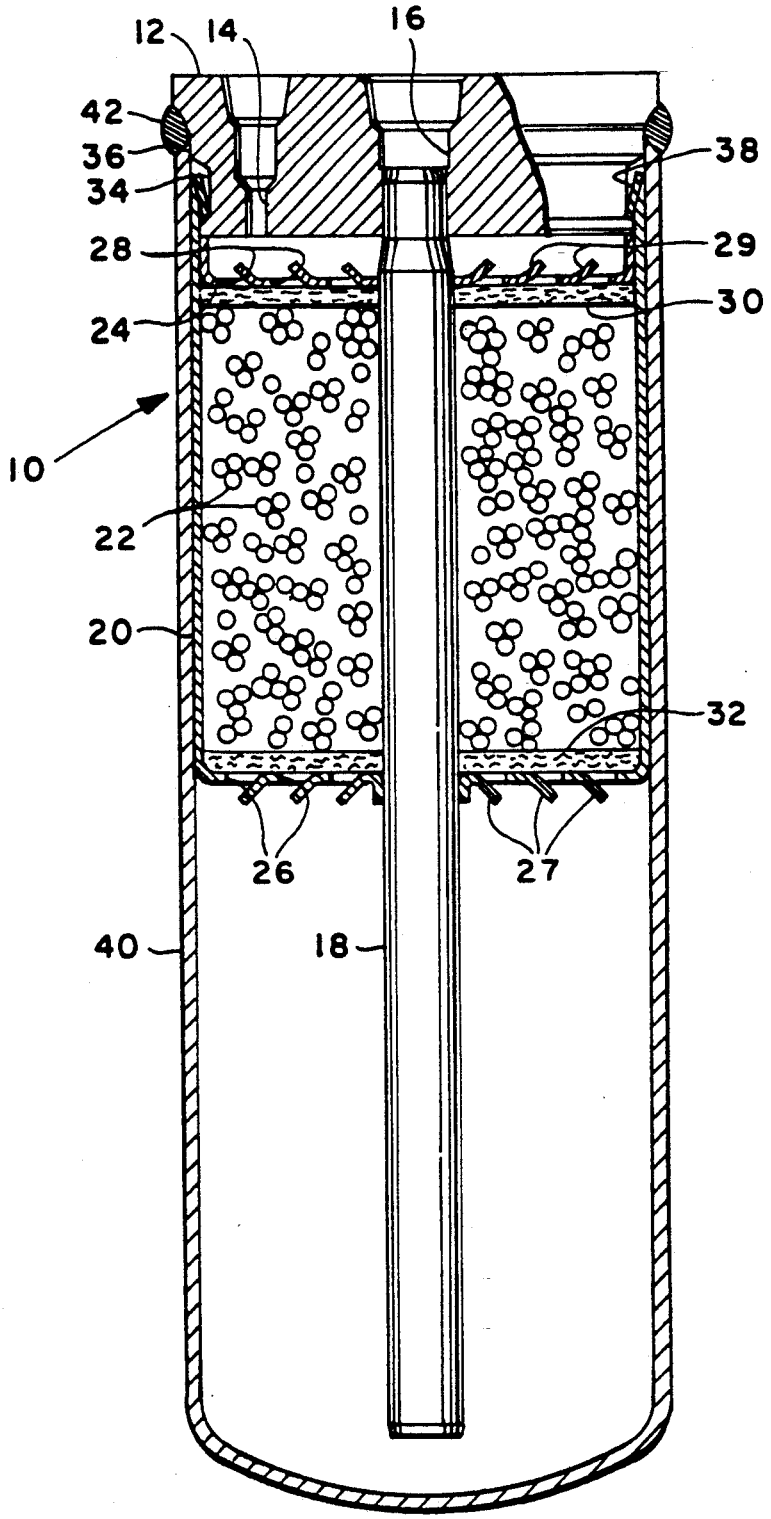
12
14
16
42
36
34
38
28
29
30
24
10
22
20
32
26
27
40
18

REFRIGERANT RECEIVER/DRIER

BACKGROUND OF THE DISCLOSURE

The present invention relates to drying, filtering, and collecting liquid refrigerant in the high pressure side of a liquid vapor recirculating refrigeration system. Typically, in such systems, a device is interposed in the refrigerant line between the condenser and the thermal expansion valve or capillary tube for the purpose of removing moisture and foreign matter which could cause freezing and/or blocking of the flow upon expansion through the valve or capillary.

Heretofore, in providing receiver/driers for automotive air conditioning systems, it has been the practice to employ desiccant beads on the order of 1/16 inch (1.6 mm) diameter in a container such that the refrigerant flows through the desiccant beads into a collecting chamber and then is discharged from the collecting chamber by flow through a standpipe. The construction of the receiver/drier, which is typically formed in a cylindrical configuration of metal material has proven to be troublesome. Where it is desired to provide a filtering function in addition to the drying function, it has been required to provide filtering media adjacent the ports in the desiccant container in order to filter all of the liquid refrigerant passing through the desiccant container in order to filter all of the liquid refrigerant passing through the desiccant material. Because of the relatively high pressures on the order of 350 psi (2415 KPa), substantial forces are created across the desiccant and filter material, which has resulted in blockage of the flow openings in the desiccant container, and also increased weight due to the additional material required in the desiccant container to withstand such forces.

The additional forces created by the large pressure drop across the filter material has rendered to construction, assembly, and attachment of the desiccant container to the header or attachment plate a problem area in mass production. It has also been desired to find a way or means of containing the desiccant during assembly in a manner which prevents the beads from spilling from the container during the assembly operations.

SUMMARY OF THE INVENTION

The present invention provides a novel and improved construction for a refrigerant receiver/drier having filters therein which construction employs a thin wall container cup for the desiccant beads with flow ports formed as louvered slots in the closed end of the cup in a manner which stiffens the closed end of the cup to resist the pressure forces on the filter material disposed adjacent the openings. The closed end of the cup has a central opening, enabling the cup to be assembled over the standpipe and the desiccant beads loaded into the cup. A cup closure plate having similarly formed louvered slots is assembled over the upper end of the standpipe and into the cup, thus closely containing the desiccant beads therein. The assembly of the standpipe, desiccant, filter, and plate is then assembled onto a header and the sides of the cup are deformed thereover to attach the cup to the header. The outer shell is then received over the assembly thus far formed in the shell, and is sealed and retained on the header by weldment.

BRIEF DESCRIPTION OF THE DRAWING

The invention is illustrated in cross-section taken along the longitudinal axis thereof.

DETAILED DESCRIPTION

Referring to the drawing, the receiver/drier of the present invention is indicated generally at 10 and comprises a header or attachment block 12 which has formed therein an inlet port 14 and an outlet port 16 centrally located in the header, and which has attached thereto, preferably by press-fitting therein, a standpipe 18. The standpipe passes centrally through a generally cup-shaped inner shell 20, which is filled with desiccant material in the form of beads 22 and the shell 20 is closed at its upper end by a cover plate 24 through which the standpipe 18 passes. The bottom or closed end of shell 20 has formed therein a plurality of spaced openings 26 which are preferably formed as louvered slits with the louvers 27 formed integrally in the bottom of the inner shell 20. Similarly, the closure plate 24 has a plurality of spaced openings 28 formed therein which are also preferably formed as louvered slits by integrally stamped louvers 29.

In the present practice of the invention, the layer of filter material 30 is disposed adjacent the openings 28 in the cover plate; and, similarly, a layer of filter material 32 is disposed adjacent the openings 26 in the bottom of the inner shell 20. In the present practice, it has been found satisfactory to employ fibrous glass material for the filter layers 30, 32; and, the material may be woven or in wool-like arrangement of the fibers. The desiccant beads 22 in the present practice of the invention are beads on the order of 1/16 inch (1.6 mm) and a material described as a molecular sieve and bearing manufacturer's designation XH-7, obtainable from UOP, Incorporated, 2511 Country Club Blvd., North Olmsted, Ohio 47070, has been utilized. The header 12, standpipe 18, desiccant container 20, and cover plate 28 are preferably formed of aluminum material for light weight and ease of fabrication.

At assembly, the lower filter layer 32 is installed in the container cup or inner shell 20, and the standpipe 18 inserted through the central opening therein. The desired amount of desiccant beads 22 is then loaded into the inner shell 20. The upper filter layer 30 is then received over the standpipe and the closure plate 24 is likewise received over the standpipe and inner periphery of the inner shell 20 to retain the filter 30 and desiccant beads 22 therein in a subassembly.

The header 12 is formed with a peripheral groove 34 in a reduced diameter portion 36 thereof. The open end of the inner cup or inner shell 20 is received over the lip of groove 34. Portions of the wall of the shell 20 are deformed inwardly as, for example, with a punch to retain the inner shell 20 onto the header 12; and, these deformed portions are denoted by reference numeral 38 in the drawing. The standpipe is then press-fitted into the outlet port 16 in the header 12.

An outer shell or casing 40 is then received over the diameter 36 of the header and secured thereon. In the present practice of the invention, the outer shell 40 is formed of an aluminum alloy similar to that of header 12; and, the outer shell is secured to the header 12 by weldment as indicated by reference numeral 42.

The receiver/drier of the present invention is constructed of lightweight material, and has a desiccant beads thereof contained in a cup-shaped inner shell received over the standpipe with a cover plate also received over the standpipe and received in the open end of the cup-shaped shell to retain the desiccant material therein. The closed end of the container cup and the cover plate have spaced flow openings therein which are formed as louvered slits, which stiffen the material thereof against the forces of the fluid pressure resulting from the flow restriction created by the pressure drop across the filter material disposed adjacent the flow openings. The present invention permits the inner shell or cup-shaped material to be assembled as a subassembly over the standpipe in a manner which reduces spillage of the desiccant material and handling problems during assembly.

Although the invention has hereinabove been described with respect to the embodiment illustrated in the drawing, it will be understood that the invention is capable of modification and variation, and is limited only by the following claims.

I claim:

1. A receiver drier for refrigerant comprising:

(a) a generally cup-shaped outer shell;

(b) a generally cup-shaped inner shell having formed in the closed end therein a plurality of spaced openings, said inner shell disposed within said outer shell;

(c) a closure header attached to the open end of said outer shell, said header having an inlet port therein and an outlet port with a standpipe attached thereover;

(d) desiccant material disposed in said inner shell; and, (e) a closure plate secured to said inner shell at the open end thereof, said closure plate having formed therein a plurality of space openings, wherein said standpipe extends through said closure plate, said desiccant and said closed end of said inner shell for communicating said outlet port with the interior region of said outer shell between the closed end thereof and the closed end of said inner shell.

2. The receiver/drier defined in claim 1, further comprising first filter means disposed adjacent said louvered openings in said inner shall and a second filter means disposed adjacent said louvered openings in said closure plate.

3. The desiccant receiver/drier defined in claim 1, wherein said closure header, said closure plate, and said inner shell with said desiccant therein are assembled over said standpipe and attached to said closure member to form a sub-assembly.

4. The receiver/drier defined in claim 1, wherein said first and second filter means each comprises a layer of fibrous material.

5. The receiver/drier defined in claim 1, wherein said spaced openings in said inner shell and said closure plate are louvered.

6. The receiver/drier defined in claim 1, wherein said header has a reduced diameter portion and said inner shell is thereover and secured thereto by localized deformation thereof.

7. The receiver/drier defined in claim 1, wherein said inner shell, the closure plate, and standpipe are formed of aluminum material.

8. The receiver/drier defined in claim 1, wherein said spaced openings in said inner shell are louvered in a manner so as to direct flow therethrough against the inner surface of said outer shell.

9. The receiver/drier defined in claim 1, wherein said desiccant material comprises beaded material.

10. The receiver/drier defined in claim 1, wherein said fitter material comprises fibrous glass material.

11. The receiver/drier defined in claim 1, wherein said standpipe is press-fitted into said closure header.

12. A subassembly for a refrigerant receiver drier comprising:

(a) a generally cup-shaped container shell having a plurality of spaced perforations formed in the closed end of said cup-shape and an aperture relatively large with respect to said perforation;

(b) desiccant material disposed in said cup-shaped container;

(c) a tubular standpipe extending through said aperture and to at least the open end of said shell;

(d) a closure plate secured to said open end of said shell and having an aperture therein with said standpipe received therethrough, said closure plate having a plurality of spaced perforations formed therein, said shell adapted for closely interfitting a canister or outer shell and said standpipe adapted for connection to a canister port.

13. The subassembly defined in claim 12, wherein desiccant material comprises beaded material.

14. The subassembly defined in claim 12, wherein said standpipe is centrally disposed through said shell.

15. The subassembly defined in claim 12, wherein said perforated end of said shell and said closure plate each have a layer of filter material disposed adjacent thereto.

16. The method of fabricating a receiver drier for refrigerant comprising:

(a) forming a cup-shaped shell member and perforating the closed end thereof;

(b) providing a tubular member and inserting said member through an aperture in the closed shell;

(c) filling said shell with desiccant;

(d) closing the end of said shell and perforating said closure and extending said tubular member through an aperture in said closure and forming a desiccant basket subassembly; and, (e) inserting said shell in a canister and connecting said tubular member to a port in said canister.

* * * * *